US009039484B1

(12) United States Patent
Mayson

(10) Patent No.: US 9,039,484 B1
(45) Date of Patent: May 26, 2015

(54) TOY TRUCK

(71) Applicant: Samuel O. Mayson, Vallejo, CA (US)

(72) Inventor: Samuel O. Mayson, Vallejo, CA (US)

( * ) Notice: Subject to any disclaimer, the term of this patent is extended or adjusted under 35 U.S.C. 154(b) by 0 days.

(21) Appl. No.: 14/120,058

(22) Filed: Apr. 22, 2014

(51) Int. Cl.
*A63H 17/05* (2006.01)
*A63H 17/38* (2006.01)

(52) U.S. Cl.
CPC ..... *A63H 17/38* (2013.01); *A63H 17/05* (2013.01)

(58) Field of Classification Search
USPC ..... 280/47.11; 446/448–453, 465
See application file for complete search history.

(56) References Cited

U.S. PATENT DOCUMENTS

| | | | | | |
|---|---|---|---|---|---|
| 2,260,679 | A * | 10/1941 | Neilson | 446/451 |
| 2,730,837 | A * | 1/1956 | Vaughan | 446/366 |
| 2,888,778 | A * | 6/1959 | Carter | 446/436 |
| 3,871,464 | A * | 3/1975 | Eden | 180/19.2 |
| 4,595,380 | A * | 6/1986 | Magers | 446/451 |
| 4,741,718 | A * | 5/1988 | Moolman | 446/451 |
| 4,765,636 | A * | 8/1988 | Speer | 280/47.11 |
| 5,240,451 | A * | 8/1993 | Clark, Jr. | 446/465 |
| D367,297 | S * | 2/1996 | Doucette | D21/433 |
| 6,272,946 | B1 * | 8/2001 | Roux | 74/498 |
| 6,488,563 | B1 * | 12/2002 | Isaacson | 446/450 |
| 7,008,291 | B2 * | 3/2006 | Bruder | 446/460 |
| 7,442,109 | B2 * | 10/2008 | Fosbenner et al. | 446/451 |
| 8,794,643 | B2 * | 8/2014 | Miroewski et al. | 280/47.11 |
| 2003/0132591 | A1 * | 7/2003 | Woodbury | 280/47.34 |
| 2012/0286487 | A1 * | 11/2012 | Miroewski | 280/47.11 |

* cited by examiner

*Primary Examiner* — J. Allen Shriver, II
*Assistant Examiner* — Erez Gurari
(74) *Attorney, Agent, or Firm* — Paul R. Martin

(57) ABSTRACT

A toy truck is described which has a steering wheel positioned behind the truck at a distance and height permitting a child to turn the wheels of the truck while standing up. The front wheels thereof are contained within a swivel assembly that enables each of the front wheels to swivel or turn to the left or right in response to force being applied on said steering wheel by an operator.

2 Claims, 9 Drawing Sheets

TOY TRUCK

BACKGROUND OF THE INVENTION

This invention relates to a moveable toy truck having a plurality of wheel sets mounted underneath the frame or chassis thereof, and wherein the front wheels mounted underneath the cab of the truck are connected to the chassis by means of a swivel assembly which enables the front wheels to be turned to the left or right, whichever direction may be desired, in response to a force exerted by a steering wheel.

BACKGROUND ART

Toy trucks are well known in the art. They come in a vast array of designs, including big rigs, where a trailer is attached to a cab, and unitary vehicles such as fire trucks, pick-ups, tow trucks, wreckers and the like. Most toy trucks include at least two sets of wheels, including a set of front wheels, but the wheels, including the front wheels, are, for the most part fixed in place, and cannot be turned to the left or right. A child playing with a truck normally has to get close to the ground in order to turn it. This is a big disadvantage, as the child will often get dirty playing in the dirt, or in the sand.

It would be advantageous to have a toy truck in which the front wheels can be turned by means of pressure exerted by a steering wheel extending up and behind the cab, so that a child can play with the truck while standing up, and not have to bend down, or get down on the ground in order to enjoy his or her toy. That is the purpose of this invention.

It is therefore an object of this invention to provide a toy truck that has front wheels mounted on a swivel assembly that can be turned by the use of a shaft to which a steering wheel is attached thus enabling the front wheels of the toy truck to be turned, or swiveled, in a given direction while the child is standing behind the truck.

This and other objects will be apparent from the description to follow.

BRIEF SUMMARY OF INVENTION

My invention is a toy truck that has a steering wheel attached to a shaft extending from the back of the truck cab, and front wheels that are rotatable in a left or right direction, which wheels move or swivel in response to pressure exerted by the steering wheel on the body of the truck and turn the truck in a left or right direction.

DETAILED DESCRIPTION OF THE INVENTION

Figure 1:
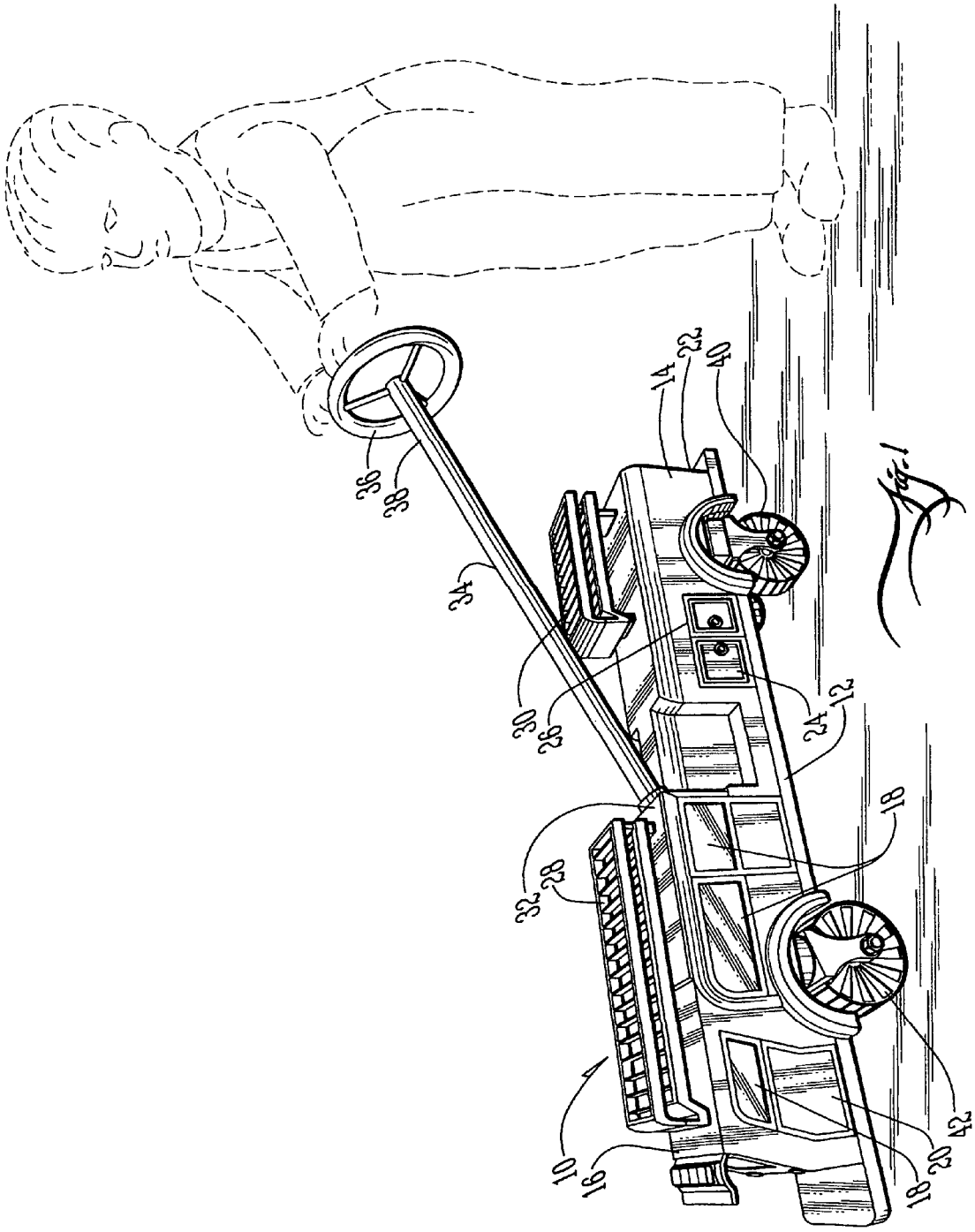
FIG. 1 is a perspective view of a preferred embodiment of the toy truck of my invention.
Figure 2:
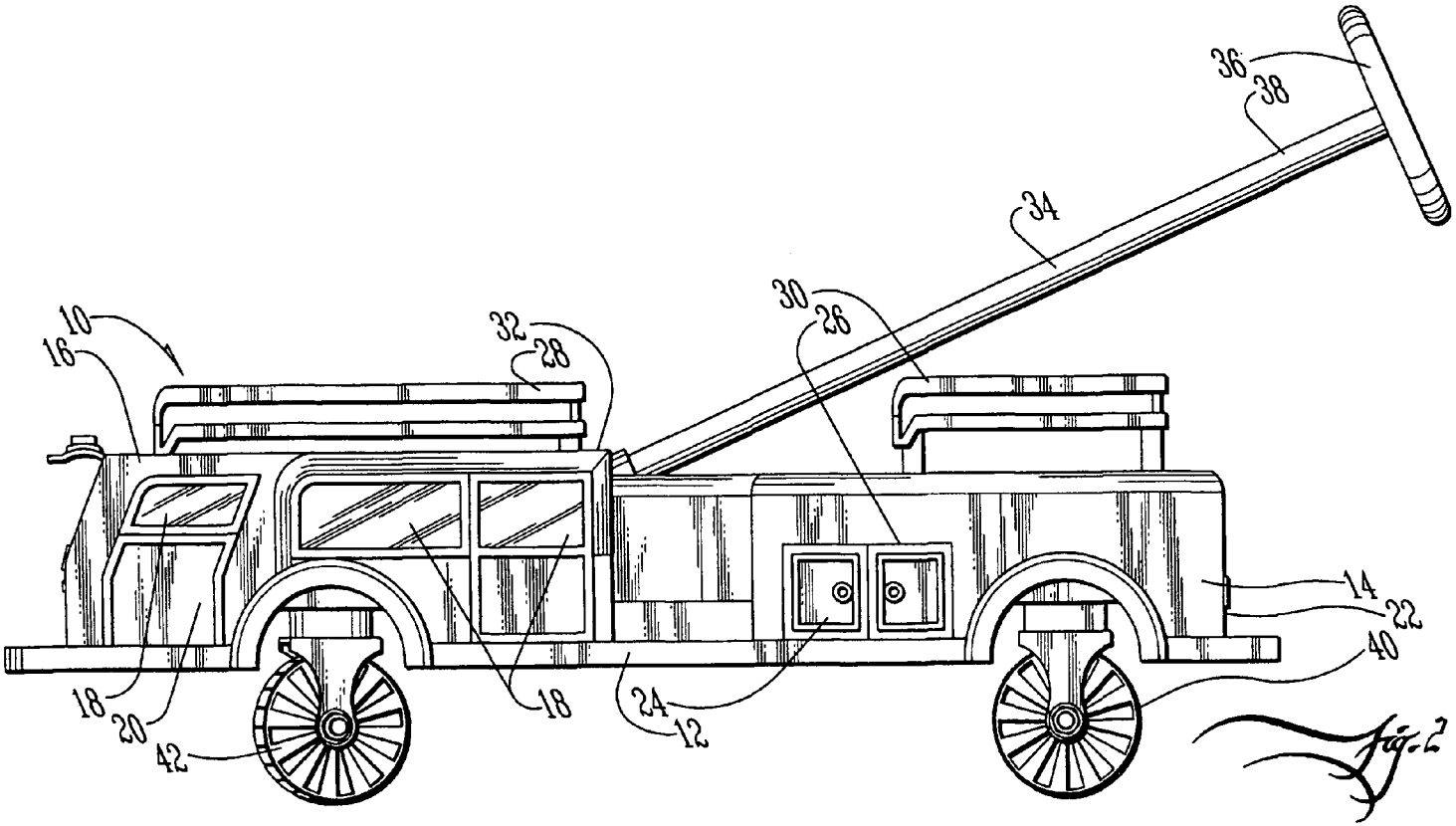
FIG. 2. Is an elevational view of one side of the truck of my invention.
Figure 3:
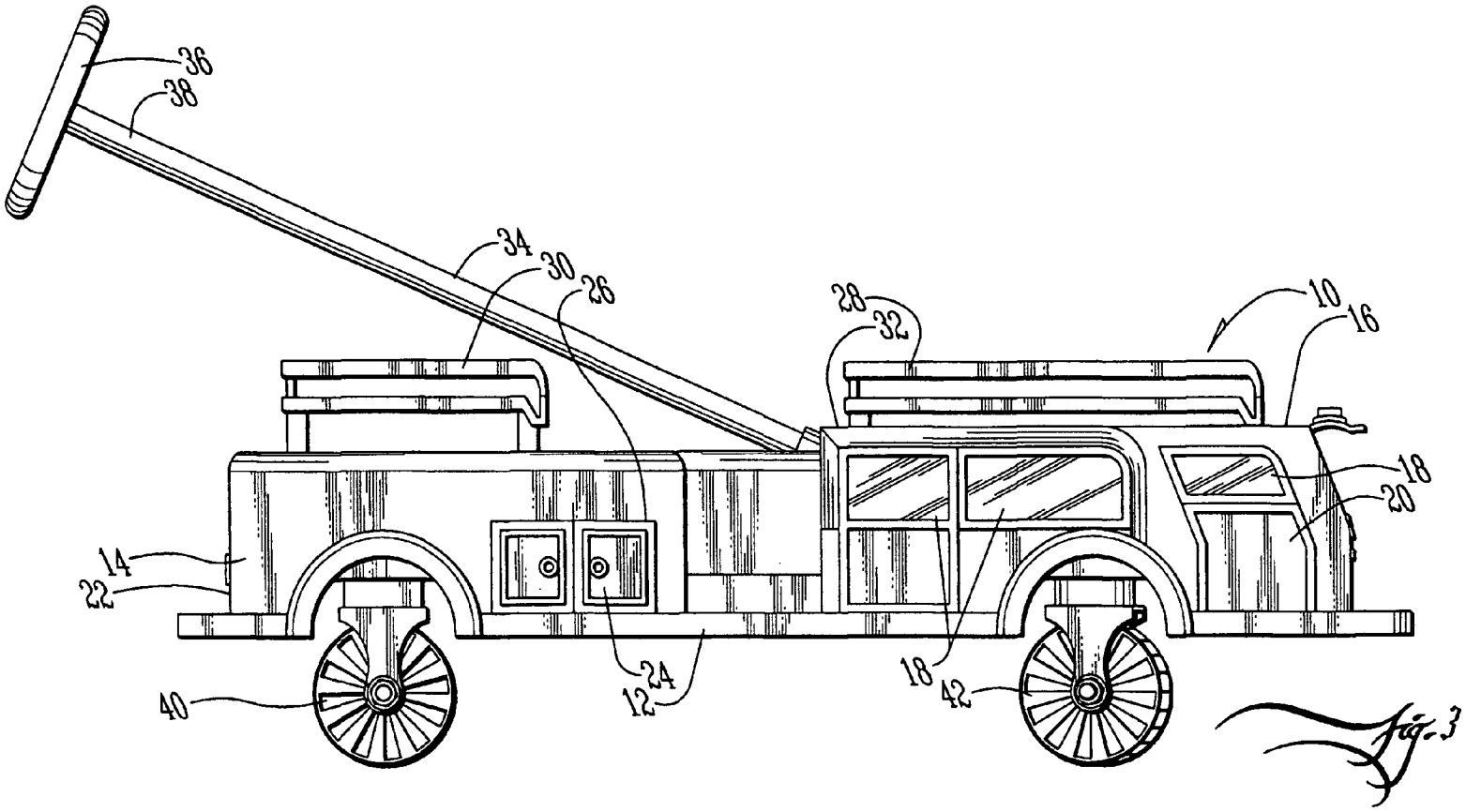
FIG. 3. Is an elevational view of the opposite side thereof to that shown in FIG. 2.
Figure 4:
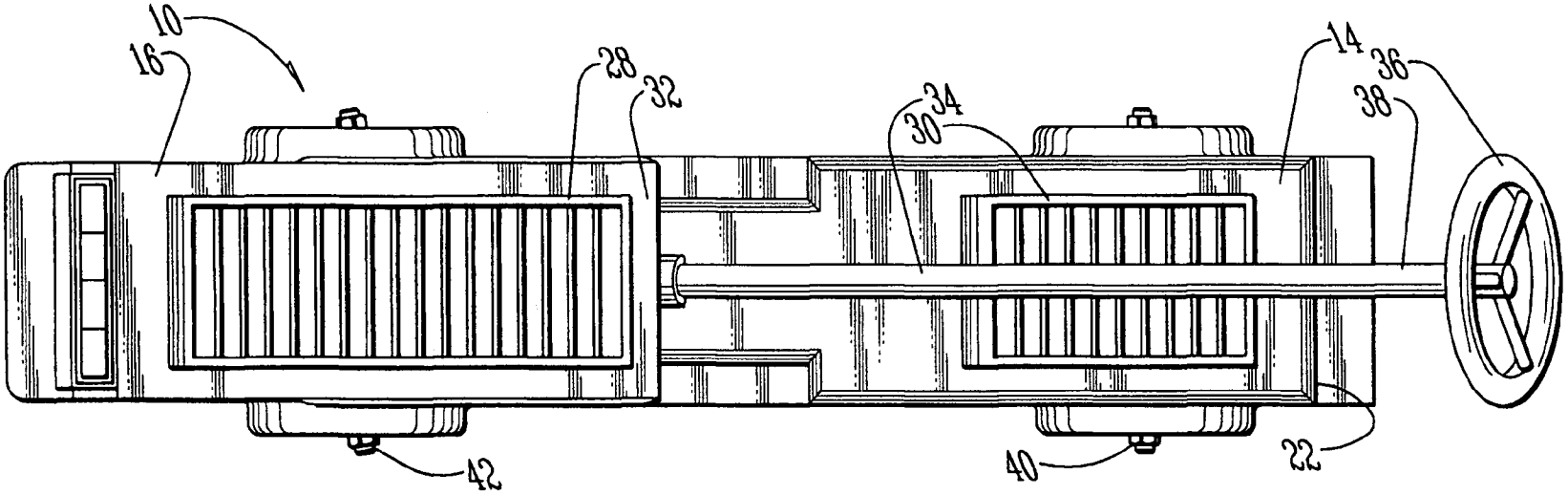
FIG. 4. Is a top plan view of the truck of my invention.
Figure 6:
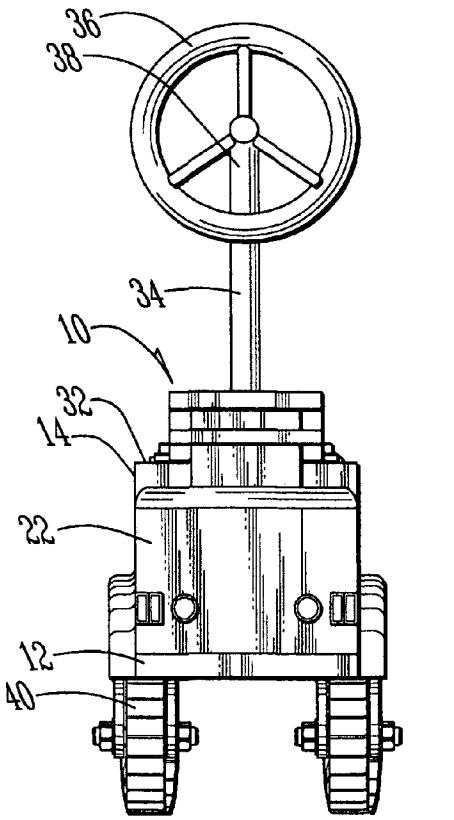
FIG. 6 is an elevational view of the rear thereof.
Figure 5:
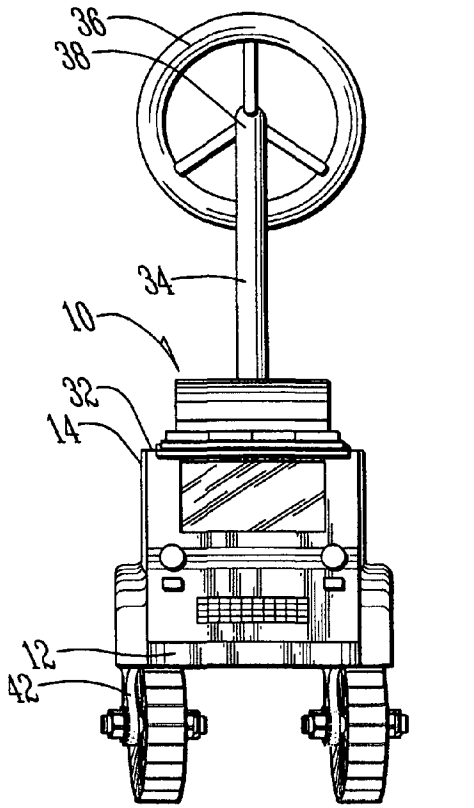
FIG. 5. Is an elevational view of the front of the truck of my invention.
Figure 7:
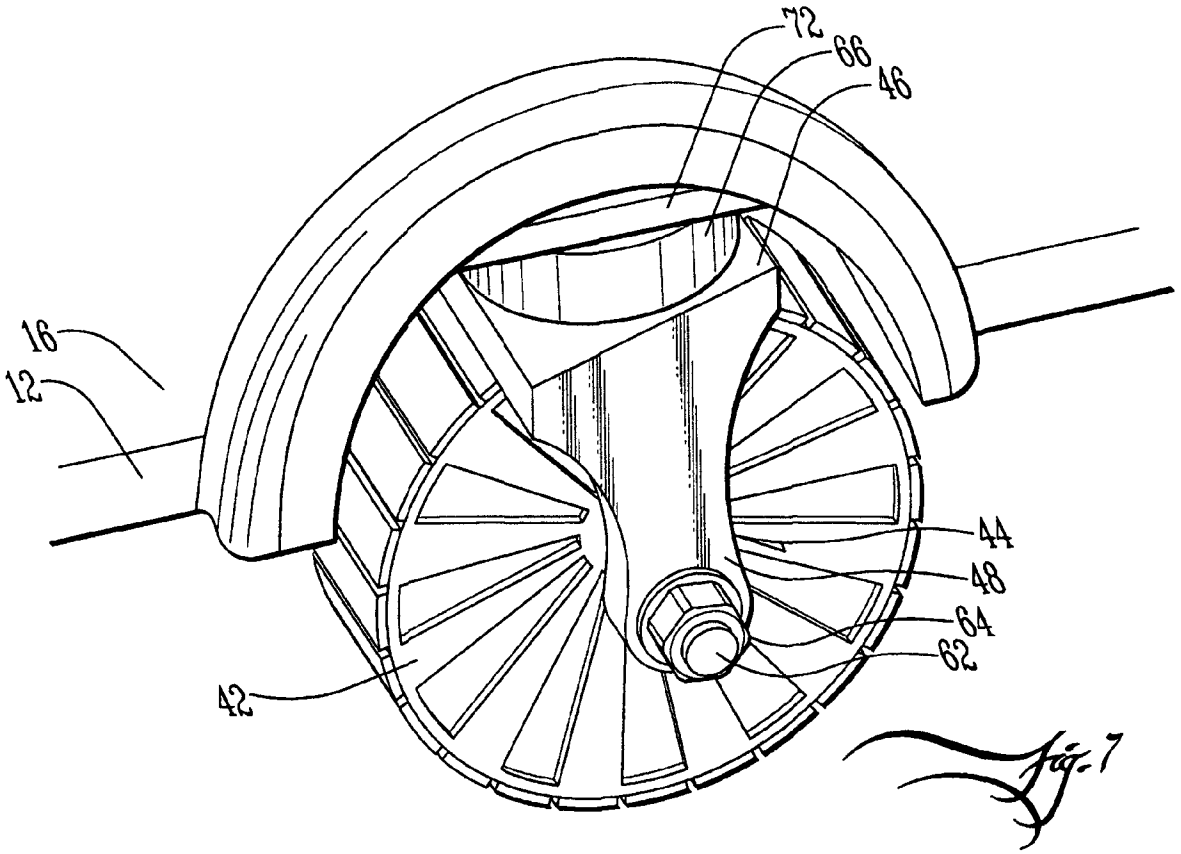
FIG. 7 is an enlarged perspective view of one of the front wheels of the truck of my invention illustrating the swivel assembly means of mounting the wheel to the truck chassis.

The toy truck of my invention is shown in FIGS. 1-10. The preferred embodiment is in the form of a fire truck, and so that is what is shown in the drawings. The truck 10 comprises a chassis 12 upon which is mounted a superstructure 14. The superstructure 14 comprises a cab 16 at the forward end, having windows 18 and a door 20 on each side. The rearward end 22 or the superstructure has doors 24 leading to storage compartments 26 for storing hoses, and the like. A pair of ladders 28 and 30 are attached to the top surface 32 of the superstructure 14, one 28 at the front, and one 30 at the back.

A shaft 34 is attached to the top of the superstructure 14 close by the cab section 16. The shaft 34 extends rearward from the superstructure 14 at an angle of approximately 45 degrees, and is sufficiently long so as to extend beyond the rear of the truck. A steering wheel 36 is mounted on the rear end 38 of the shaft. One set of wheels 40 is mounted on the underside of the chassis 12 of the truck at the rear thereof. Another set of wheels 42 is mounted on the underside of the chassis 12 at the front of the truck underneath the cab. The wheels 42 are part of a swivel assembly 44 so mounted so as to enable the wheels 42 to turn or swivel in a left or right direction independently, by means of pressure being applied by an individual grasping the steering wheel 36, and exerting pressure thereon.

Figure 8:
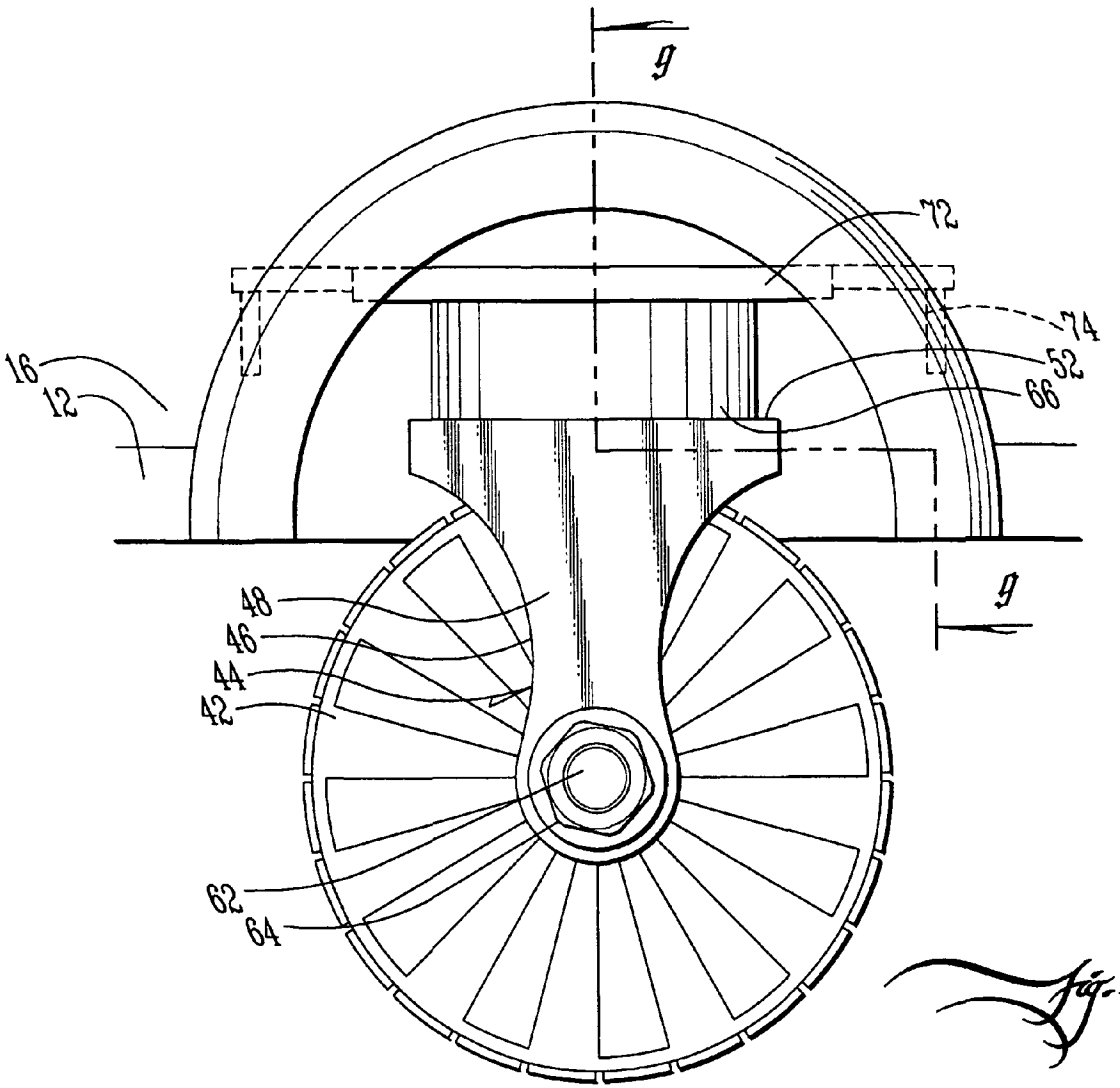
FIG. 8 is an elevational view of one of the front wheels of my truck showing the swivel assembly means mounting it to the truck chassis.
Figure 9:
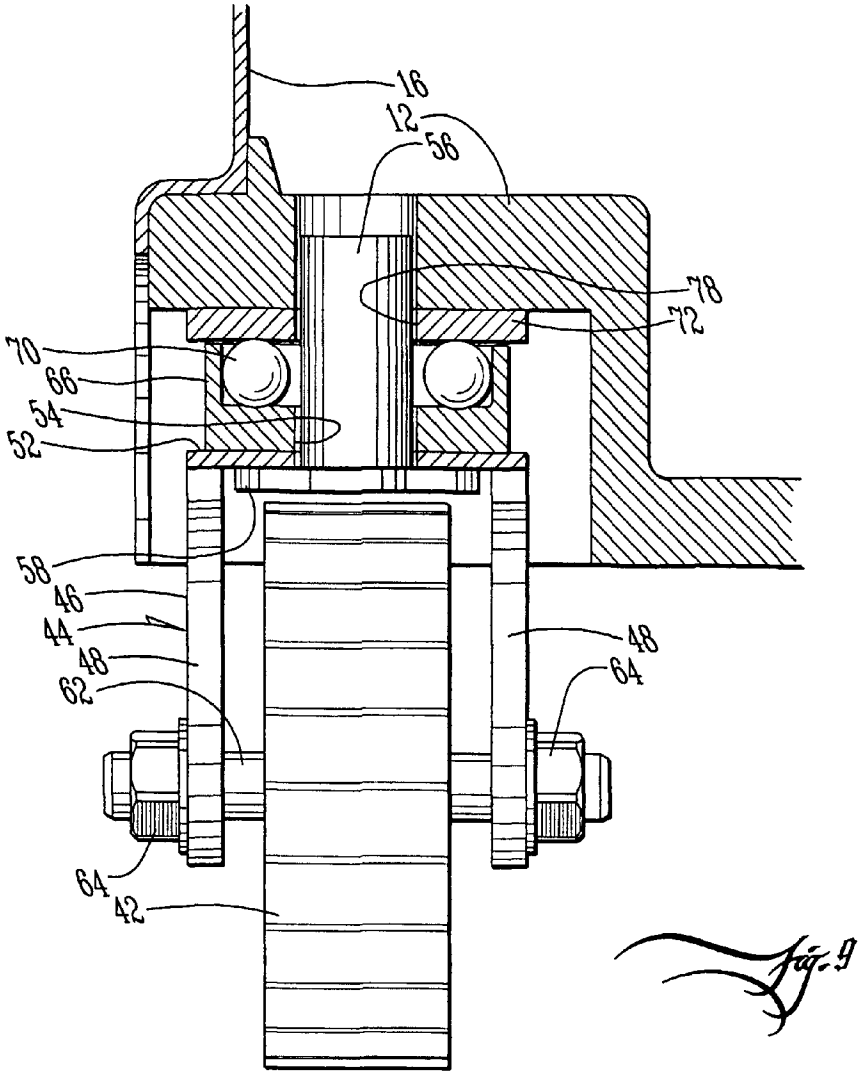
FIG. 9 is a front elevational view through the line 9-9 of FIG. 8.
Figure 10:
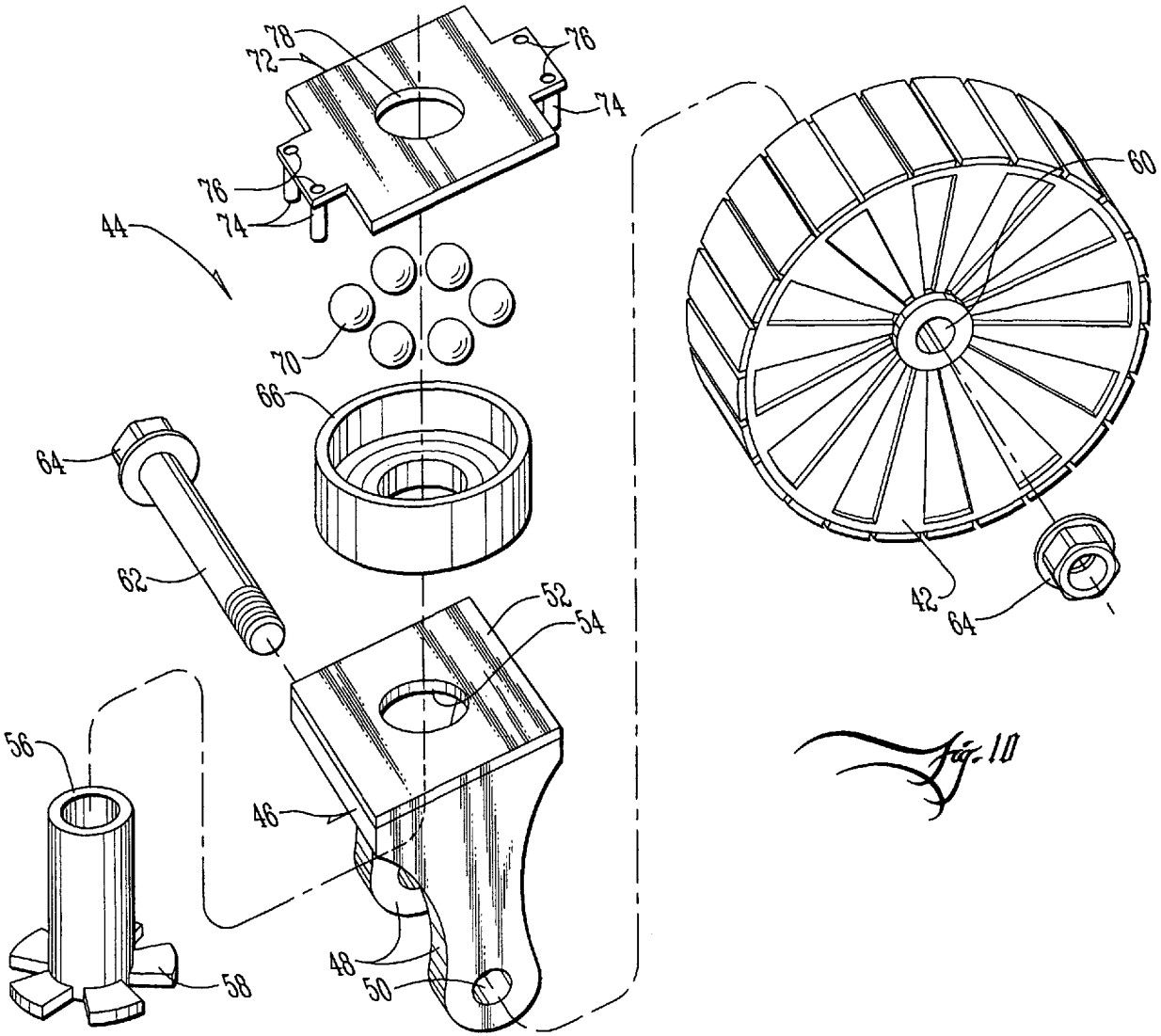
FIG. 10 is an enlarged view of the swivel assembly mounting means of one of the front wheels of my truck, to the chassis of the truck, enabling the wheel to swivel or turn in response to pressure exerted on the truck chassis by a steering wheel.

The swivel assembly 44 by which the front wheels 42 are attached to the under surface of the chassis 12 is shown in FIGS. 8-10. As best seen in FIG. 10, the swivel assembly 44 comprises a U-shaped clevis 46 which has downwardly extending ears 48 which have holes 50 in the lower ends thereof. The top surface 52 of the clevis 46 has a hole 54 therein, through which a tube 56 is extended, from the undersurface of the clevis 46. The tube 56 has outwardly extending flanges 58 which abut the underside of the clevis 46 when in position.

Each wheel 42, which has a hole 60 in the center thereof, is positioned between the ears 48 of the clevis 46, and secured therein by an axle 62 which extends through the holes 60 in the ears 48 of the clevis 46, and through the hole 60 in the center of the wheel 42 and which is secured in place by nut 64.

A bearing trace 66 sits on top of the top surface 68 of the clevis 46. The bearing trace 66 contains a set of bearings 70 seated therein.

A cover plate 72 overlies the bearing trace 66 and is secured to the underside of the chassis 12 by screws 74 which project through holes 76 in the plate 72 and are secured to the underside of the chassis 12. The cover plate contains a hole 78 in the center thereof through which the upper end of tube 56 projects.

Thus, when the swivel assembly 44 is assembled and attached to the undersurface of the chassis 12, pressure is exerted on the steering wheel 36 by a child or other individual, causes the wheels 42 to swivel to the left or right in accordance with the force exerted on the steering wheel 36 by the operator.

It will be recognized by those skilled in the art that the present invention is well adapted to carry out the objectives and obtain the ends and advantages herein. Although the invention has been described in connection with specific preferred embodiments, it should be understood that the invention as claimed should not be unduly limited to such specific embodiments. Indeed, various modifications of the described modes for carry out the invention which are obvious to those skilled in the art are intended to be within the scope of the following claims.

I claim:

1. A toy truck comprising a truck having a chassis and a superstructure, a steering shaft having forward and rearward ends, said forward end extending from the top surface of said superstructure, a steering wheel attached to the rearward end of said shaft, a pair of rear wheels attached to the undersurface of said chassis, a pair of swivel assemblies, each containing a wheel, mounted parallel on the underside of the front end of said chassis, wherein each of said swivel assemblies comprises a U-shaped clevis having a flat center plate with a hole in the center thereof, ears extending downward from each side of the center plate, each of said ears having a hole adjacent the distal end thereof, a wheel having a hole in the center thereof positioned between the downwardly extending ears of said clevis, and secured thereto by a bolt extending through the holes in said ears, and through the hole in the center of said wheel, a nut securing said bolt into position between said ears, a circular bearing trace having a hole in the center thereof positioned on top of said flat center plate of said clevis, said trace containing a plurality of ball bearings in a groove surrounding said hole, a top cover plate having a hole in the center thereof covering said bearing trace, and secured to the underside of the chassis of said truck by means of screws, a tube with outwardly extending flanges at the lower end extending upwardly through the hole in said clevis plate, the hole in said bearing trace, and the hole in said top cover plate, said flanges abutting the underside of said clevis plate when in position, whereby the front wheels of said truck swivel in accordance with the direction of the force applied on said steering wheel.

2. The toy truck of claim 1 wherein the rearward end of said steering shaft extends upward and backward from the back of said cab a distance and at an angle that enables a child to turn the steering wheel attached to the rearward end of said shaft while in a standing position.

* * * * *